United States Patent [19]

Quay

[11] Patent Number: 4,516,292

[45] Date of Patent: May 14, 1985

[54] WIRE-COVERED DOFFER FOR SLIVER HIGH PILE FABRIC KNITTING MACHINES

[75] Inventor: Earl R. Quay, Orangeburg, S.C.

[73] Assignee: Mayer, Rothkopf Industries, Inc., Orangeburg, S.C.

[21] Appl. No.: 538,142

[22] Filed: Oct. 3, 1983

[51] Int. Cl.[3] ..... D01G 15/14

[52] U.S. Cl. ..... 19/112; 19/114

[58] Field of Search ..... 19/112, 114, 113, 105, 19/106 R; 66/9 B

[56] References Cited

U.S. PATENT DOCUMENTS

| | | | |
|---|---|---|---|
| 241,051 | 5/1881 | Moulton | 19/112 |
| 243,171 | 6/1881 | Stone | 19/112 |
| 421,153 | 2/1890 | Ashworth | 19/112 |
| 1,084,786 | 1/1914 | Calderwood | 19/112 |
| 3,928,986 | 12/1975 | Thore | 66/9 B |

FOREIGN PATENT DOCUMENTS

| | | | |
|---|---|---|---|
| 97 | of 1889 | United Kingdom | 19/112 |

*Primary Examiner*—Louis K. Rimrodt
*Assistant Examiner*—J. L. Kravitz
*Attorney, Agent, or Firm*—Harding, Earley, Follmer & Frailey

[57] ABSTRACT

A wire-covered doffer for feeding fibers to the needles of a sliver high pile fabric knitting machine, in which the card clothing is of generally rectangular configuration and envelops the doffer roll so that the longitudinally spaced ends of the segment are disposed in tight abutting relationship to each other on the roll. A pair of circumferentially spaced clamps mounted on the doffer roll tightly secure the segment of card clothing to the periphery of the roll, stretching the segment slightly to impart a slight tension thereto. Each clamp supports a row of spaced points for impalement and retention of the segment of card clothing. Each row of points extends transversely relative to the periphery of the doffer roll, and penetrates the segment of card clothing at a location spaced a short distance inwardly from one of the two abutting ends of the segment. Threaded connectors affix the clamps to the doffer roll.

15 Claims, 4 Drawing Figures

WIRE-COVERED DOFFER FOR SLIVER HIGH PILE FABRIC KNITTING MACHINES

FIELD OF THE INVENTION

The present invention concerns the knitting of sliver high pile fabrics on circular knitting machines such as the type illustrated in Tauber U.S. Pat. No. 1,114,414, Hill U.S. Pat. No. 3,010,297, Schmidt U.S. Pat. No. 3,299,672, Wiesinger U.S. Pat. No. 3,427,829 and Thore U.S. Pat. No. 3,928,986. High pile fabric knitting machines generally are rotary knitting machines provided with a plurality of carding heads, constituting fiber transfer and feeding units, for supplying carded sliver fibers to the knitting needles. Usually, the knitting needles are mounted independently in a cylinder, which is rotatable relative to the several carding heads disposed at circumferentially spaced locations around the cylinder.

DESCRIPTION OF THE PRIOR ART

The carding heads for feeding carded sliver fibers to the needles of high pile fabric knitting machines are constituted of at least one pair of rotatable sliver feed rolls—usually having either wire-covered or fluted peripheries—a rotatable wire-covered main cylinder and a rotatable wire-covered doffer. The sliver feed rolls draw sliver in rope form from a source of supply, and deliver the fibers, in sheet form, to the main cylinder. The latter, acting as a transfer medium, conveys the sheet of sliver fibers to the doffer which, in turn, feeds the fibers to the needles of the knitting machine. In order to properly transfer the fibers during their delivery to the needles, the main cylinder is caused to rotate faster than the sliver feed rolls, and the doffer is caused to rotate faster than the main cylinder.

In clothing the doffer, it has been the practice for decades to wrap an elongated, narrow strip of wire-covered card clothing helically about the peripheral surface of the doffer roll. Each end of the helically wound strip is secured to the rim of the doffer roll by fastening means, such as a threaded bolt passing through the rim and being secured thereto by a threaded nut. The helical wrapping of the doffer is time consuming and difficult. No matter how careful the winding, empty spaces or voids often occur in the card clothing because such defects usually are inherent in helical winding. Further, in the helical winding of the elongated strips of card clothing, the spirals often depart from a true helix, the result of which is to create undesirable lines or shadows in the high pile of the fabric being knit. Such lines or shadows are detrimental to the quality of the fabric.

Relatively little effort has been made in the past to overcome the problems inherent in the helical winding of card clothing on the doffer. One attempt to solve the problem is illustrated by Moore U.S. Pat. No. 3,095,614. In an attempt to improve fiber uniformity in the pile face of sliver high pile fabric, that patent proposed to replace helical wound doffer clothing by a plurality of separate strips of card clothing extending at an angle transversely across the periphery of the doffer. However, so far as is known, that proposed solution was not successful and the arrangement never went into commercial use.

SUMMARY OF THE INVENTION

The primary object of this invention is to dispense with the helical winding of card clothing on a doffer, thus eliminating the problems inherent in such process, and provide in lieu thereof a doffer of which the card clothing comprises an integral, one-piece, generally rectangular segment which is free of voids and other defects, and of which the longitudinally spaced ends are disposed in tight abutting relationship transversely on the doffer roll to provide a closure devoid of gaps.

A further object of the invention is to provide a new and improved doffer whereof novel clamping means tightly secure a generally rectangular segment of card clothing to the doffer roll under a slight degree of tension and in a manner to provide full population of the doffer wires, i.e. to ensure that the periphery of the doffer is entirely and uniformly covered by wire.

A further object is to provide new and improved fastening means for securing card clothing tightly to a doffer, such fastening means including a pair of circumferentially spaced clamps mounted on the doffer roll and having transversely spaced points for impalement of the card clothing to attach the clothing firmly to the clamps, whereby the card clothing is stretched about the periphery of the doffer roll and tightly hugs the outer surface thereof while clamped.

The spaced points for impalement of the card clothing are disposed in uniformly spaced relation in rows extending transversely across the periphery of the doffer, and engage or penetrate the segment of card clothing at locations spaced a short distance inwardly from its transversely extending abutting ends.

The invention not only provides a secure, tightly mounted integral segment of card clothing for the doffer, which is free of gaps, openings and other defects inherent in the helical wound doffers presently in use, but the arrangement of the invention permits the rapid application of clothing on a doffer and the rapid disassembly of old card clothing from the doffer, incident to reclothing the doffer roll.

Other objects and advantages of this invention will be readily apparent from the accompanying detailed description of the preferred embodiment thereof, which is illustrated in the views of the accompanying drawing.

DESCRIPTION OF THE INVENTION

Figure 1:
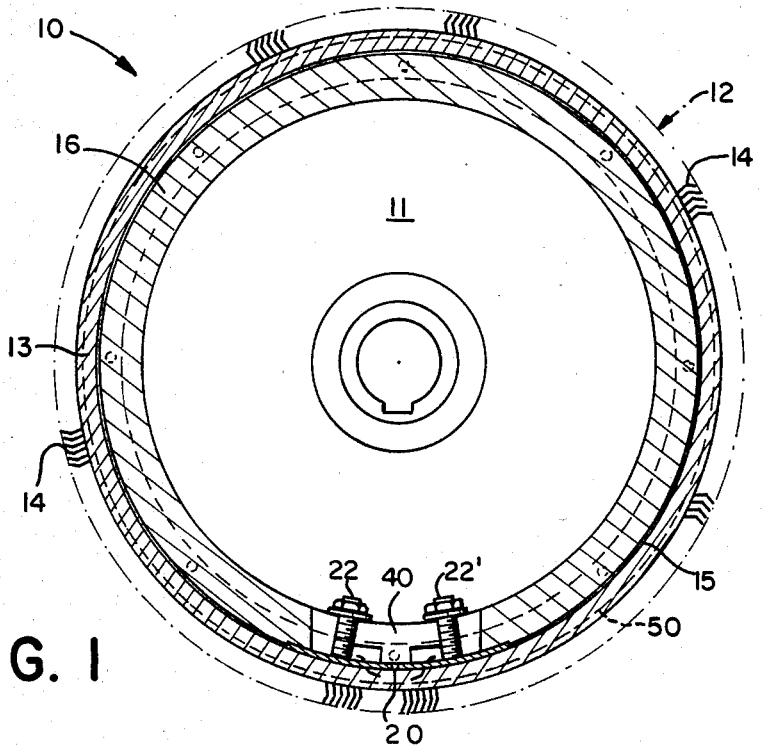
FIG. 1 is a sectional view in side elevation of a doffer embodying this invention.

Referring first to FIG. 1 of the drawings, there is illustrated the preferred embodiment of this invention constituting a rotatable wire-covered doffer 10 for feeding fibers to the needles of a conventional sliver high pile fabric knitting machine (not shown). The doffer 10 is composed of the usual cast metal doffer roll 11 having a smooth-peripheried rim 16 surrounded by wire-covered card clothing 12 composed of a backing 13 from which protrude a plurality of doffer wires 14.

The backing 13 of the card clothing may be of usual construction comprised of, for example, an inner layer of one or more plies of cotton webbing and an outer layer of rubber. The doffer wires 14 are constituted of the usual U-shaped wires having their spaced distal ends extending outwardly of the periphery of the doffer and having their joined or connected proximal ends anchored in the backing 13. The doffer wires 14 may be constituted of wire of the self-cleaning type described in Quay U.S. Pat. No. 4,408,371.

The doffer rim 16 is relatively wide and its outer surface is cylindrical to provide the doffer roll 11 with a smooth or flat, relatively wide periphery. A layer of adhesive tape 15 preferably is interposed between the card clothing 12 and the rim 16 to provide a covering to protect the periphery of the roll 11 from marring by the inner portions of the wires 14. The outer surface of the tape or covering 15 is smooth to accommodate the attachment of the clothing 12 to the doffer roll 11.

Preferably, the card clothing 12 is an integral segment of such material having a generally rectangular shape or configuration, the width of which is substantially equal to the width of the periphery of the doffer roll 11. The length of the segment of card clothing 12 is substantially equal to the circumference of the doffer roll 11. When the segment of card clothing 12 is wrapped around the periphery of the doffer roll 11, as illustrated in FIG. 1, it is tensioned slightly and its longitudinally spaced ends 18, 19 (FIG. 2, 3) are pressed together in abutting relationship to each other to provide a tight transverse joint or closure 20 devoid of gaps or openings.

Figure 2:
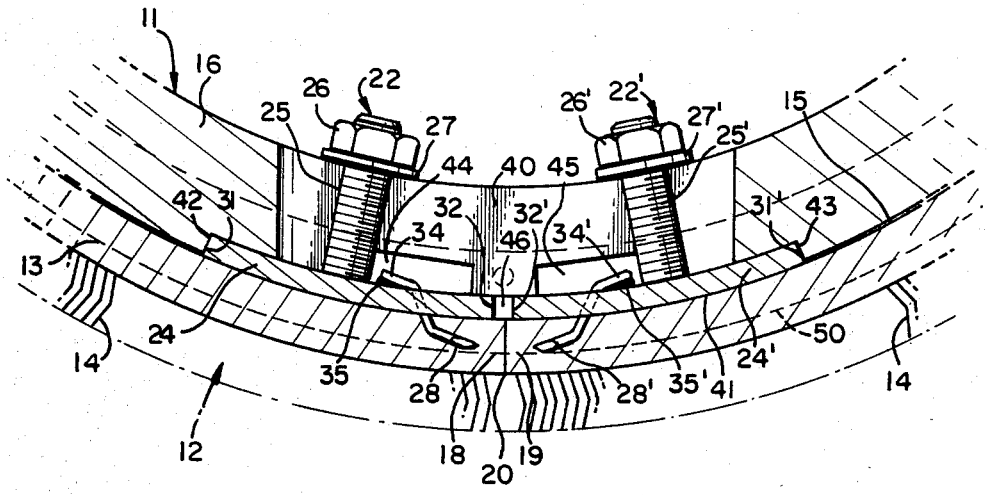
FIG. 2 is an enlarged fragmentary view illustrating the novel fastening means for securing card clothing to the periphery of the doffer roll shown in FIG. 1.

FIG. 2 illustrates the novel fastening means of this invention by which the rectangular segment of card clothing 12 is securely affixed to the doffer roll 11. The fastener or fastening means preferably is constituted of a pair of circumferentially spaced clamps 22, 22' mounted on the rim 16 of the doffer roll 11. Clamp 22 is composed of a transversely extending plate 24 of arcuate cross-section, a threaded stem 25 affixed to the concave underside of the plate 24, a threaded nut 26 and washer 27 engageable with the stem 25 and a plurality of points 28 protruding angularly outward from the convex outside surface of plate 24.

Preferably, the width of the arcuate transverse plate 24 is substantially equal to the width of the periphery of the doffer roll rim 16. Plate 24 is provided with circumferentially spaced transverse edges 31 and 32, said edges defining the spaced ends of the plate in its longitudinal or arcuate dimension.

Figure 3:
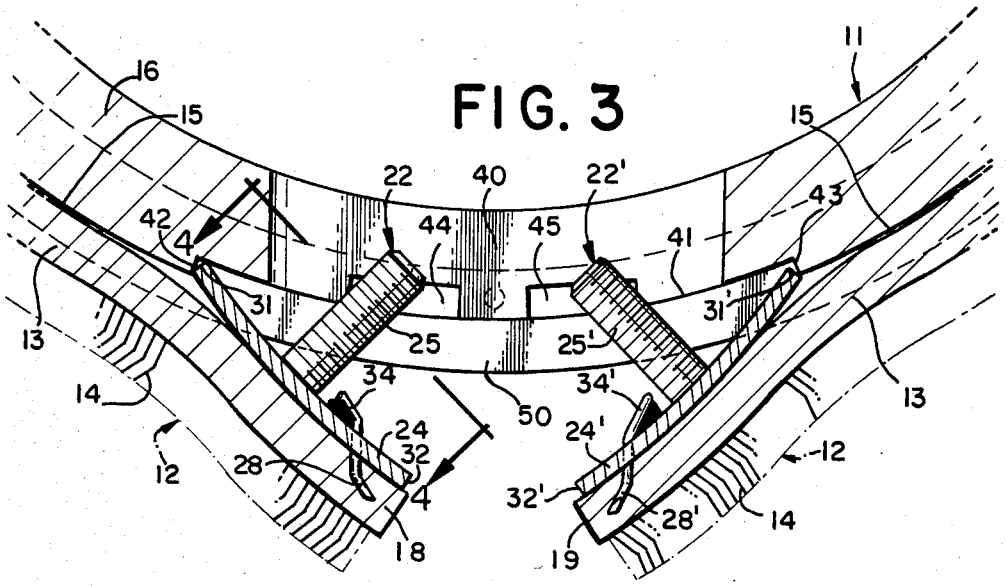
FIG. 3 is a view similar to FIG. 2 illustrating the fastening means preparatory to being snapped into engagement with the doffer roll.
Figure 4:
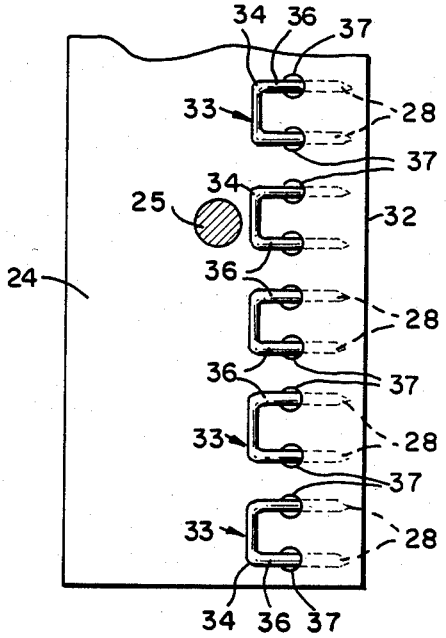
FIG. 4 is a fragmentary view of the underside of the arcuate staple-supporting plate of one of the two clamps or components of the fastening means, looking in the direction of the angled arrows 4—4 of FIG. 3.

As best shown in FIG. 4, the inclined points 28 are mounted on plate 24 and are uniformly spaced from each other along a transverse line or row of points adjacent the inner plate edge 32. Preferably, the spaced points 28 constitute the sharpened or pointed distal ends of a plurality of transversely spaced U-shaped staples 33, the inner or proximal ends 34 of which are soldered or welded to the concave underside of the mounting plate 24 at 35 (FIG. 2). The spaced shanks 36 of the U-shaped staples are bent upwardly to extend from their proximal ends 34 up and through holes or openings 37 in the mounting plate 24, and emerge from that plate to overlie its outer convex surface, with the points 28 spaced from, and extending angularly relative to, the periphery of the doffer roll 11. The points 28 constitute impaling means for engaging or penetrating the segment of card clothing 12 at a location spaced a short distance inwardly from its transverse edge or end 18 (FIGS. 2, 3).

The threaded stem 25 of clamp 22 extends radially inward of the doffer 10 through a short, circumferentially extending slot 40 located in the center of the rim 16 of the doffer roll 11. The threaded stem 25 is of a length greater than the thickness of the rim 16 of the doffer, whereby its distal end emerges radially inward beyond the slot 40. The threaded stem 25 is connected to the doffer rim 16 by the washer 27 and the nut 26, the latter being engaged threadingly on the distal end of the stem 25. The threaded stem 25, the washer 27 and the threaded nut 26 constitute securing means for affixing the clamp 22 to the doffer roll 11.

The second clamp 22' is identical in structure to clamp 22, and is comprised of a transversely extending mounting plate 24' of arcuate cross-section, a threaded stem 25', a threaded nut 26', a washer 27' and a plurality of uniformly spaced inclined points 28' disposed in a row extending transversely relative to the periphery of the doffer roll 11. The points 28' constitute impaling means for impalement of the segment of card clothing 12 at a location spaced a short distance inwardly from its end or transverse edge 19 (FIGS. 2, 3). The arcuate plate 24' is provided with circumferentially spaced transverse edges 31' and 32', the row of inclined points 28' mounted on clamp 22' being aligned adjacent the inner edge 32' of clamp 22'. The points 28' have proximal ends 34' soldered or welded to the concave underside of plate 24' at 35'.

The novel fastening means of this invention constituted by the pair of circumferentially spaced clamps 22, 22' ensures that the segment of card clothing 12 is firmly and tightly secured to the periphery of the doffer roll 11 with the transverse edges or ends 18, 19 of the segment 12 pressed tightly together in abutting or contiguous relationship free of any gaps or openings. The integral rectangular construction of the card clothing segment 12, together with the clamps 22, 22', provides full population of the wires 14 on the doffer 10, thereby ensuring that the periphery of the doffer roll 11 is entirely and uniformly covered by doffer wire.

The mounting plates 24, 24' of the clamps 22, 22' are disposed or nestled side-by-side within an arcuate groove 41 formed in the periphery of the doffer roll 11, and extending transversely thereof. Groove 41 is defined by circumferentially spaced edges 42, 43 extending transversely across the rim 16 of the doffer roll 11. As will be observed from FIG. 2, when the clamps 22, 22' are secured in place on the doffer rim 16, the outer transverse edge 31 of clamp 22 is contiguous with the transverse edge 42 of the groove 41, and the outer transverse edge 31' of clamp 22' is contiguous with the transverse edge 43 of the groove 41.

The arcuate length of the groove 41 is slightly greater than the sum of the arcuate lengths of the two curved mounting plates 24, 24', to allow for a slight clearance or gap 46 between the opposing transverse plate edges 32, 32'. This arrangement permits the ends 18, 19 of the card clothing segment 12 to extend a slight distance beyond the inner transverse edges 32, 32' of the clamps 22, 22', to ensure that the abutting edges of the card clothing are pressed or squeezed together to provide a tight joint 20 devoid of gaps.

The depth of the transverse groove 41 is slightly less than the thickness of the arcuate plates 24, 24' of the clamps 22, 22'. The slight reduction in depth of the groove 41 over the thickness of the mounting plates 24, 24' compensates for the thickness of the adhesive tape 15 intervening between the bare periphery of the doffer roll 11 and the card clothing 12. Thus, when the clamps 22, 22' are affixed in place within the transverse groove 41, the outer convex surfaces of their plates 24, 24' are flush with the smooth outer surface of the tape 15. As will be observed, the arcuately extending transverse groove 41 is disposed between the circumferentially spaced ends of the tape 15.

A pair of circumferentially spaced, transversely extending recesses 44, 45 are disposed in the bottom of the arcuate groove 41 to provide clearance for the proximal ends 34, 34' of the points 28, 28'.

FIG. 3 illustrates the clamps 22, 22' having their points 28, 28' impaled, respectively, with the spaced ends 18, 19 of the segment of card clothing 12 in preparation for the clamps being snapped into the slot 40 formed in the doffer roll 11. The card clothing 12 completely envelops the periphery of the doffer roll 11, and its spaced ends 18, 19 are firmly impaled on the two opposing transverse rows of spaced points 28, 28'. The outer transverse edges 31, 31' of the clamps 22, 22' are disposed within the arcuate groove 41 so as to abut, respectively, against the spaced transverse edges 42, 43 of that groove.

With the abutting transverse edges 31, 42 and 31', 43 functioning as pivots or hinges, the two clamps 22, 22' are snapped or cammed into place, whereby their threaded stems 25, 25' pass radially inward through the slot 40 in the doffer roll 11. Their distal ends emerge from the bottom of the slot 40 and are secured to the rim 16 by the washers 27, 27' and threaded nuts 26, 26', as illustrated in FIG. 2. Since the opposing inner transverse edges 32, 32' of the clamps 22, 22' are spaced slightly inward from their corresponding ends 18, 19 of the card clothing segment 12, the two clamps 22, 22' are operative to squeeze or press the abutting ends 18, 19 of the card clothing 12 tightly together to provide a firm joint 20 devoid of gaps. The clamps 22, 22' retain the clothing segment 12 under a slight tension on the doffer roll 11. The smooth outer surface of the tape 15 permits or facilitates the segment 12 to stretch and slide slightly as it is tensioned, thereby distributing the tension force uniformly over the segment.

To prevent the card clothing 12 from shifting transversely relative to the doffer 10, as a result of the force of the needles entering the doffer wires 14, an annular flange 50 is affixed, by suitable means such as bolts, welding, or the like, to the downstream end of the doffer, i.e. to the end of the doffer from which the needles emerge with fibers in their hooks. The flange 50 abuts the card clothing 12 at the downstream end of the doffer 10. As illustrated in FIGS. 1, 2 and 3, the rim of the flange 50 terminates in a circle having a diameter somewhat less than the outer diameter of the backing 13 of the card clothing 12. Thus, the rim of the flange 50 is spaced radially inward from the doffer wires 14, so that it does not interfere with the passage of the needles through the wires.

The annular flange 50 also functions to align accurately the several rows of wires 14 extending transversely across the doffer 10. The curved mounting plates 24, 24' of the arcuately spaced clamps 22, 22' also abut against the flange 50, whereby the flange aids in their alignment relative to each other and in the transverse alignment of the rows of doffer wires 14 adjacent the joint 20. By ensuring that the several rows of doffer wires 14 are accurately aligned transversely across the doffer roll, the undesirable barré effect, which frequently occurs in the knitting of high pile fabrics, is avoided.

The spaced clamps 22, 22', which function as card clothing retainers or impaling means, may assume a variety of forms within the scope of this invention. For example, such retainers 22, 22' may be in the form of cleats affixed to the underside of the rim 16 of the doffer roll 11 by any suitable means such as bolts, welding, or the like. In such arrangement, the cleats constitute curved plates, similar to the mounting plates 24, 24', having impaling means, similar to points 28, 28', extending radially upward and outward of the doffer roll 11 through holes suitably formed in its rim 16 for impalement with the card clothing 12.

More than two retainers, cleats or clamps 22, 22' may be utilized in securing the card clothing 12 to the periphery of the doffer roll 11. For example, if necessary or desirable, one or more additional such retaining or impaling means may be inserted in the doffer ensemble intermediate the abutting ends 18, 19 of the card clothing 12 where clamps 22, 22' are located.

This invention constitutes a substantial improvement over prior practices in the construction of doffers for feeding fibers to the needles of a sliver high pile fabric knitting machine. The past practice of winding narrow strips of card clothing helically on the doffer, and the manifold problems inherent in that arrangement, are eliminated. The assembly permits the rapid removal of old and worn card clothing from the doffer 10, and the quick reclothing of the doffer roll 11 with a fresh segment of card clothing 12.

The invention not only provides a tight, gapless joint 20 at the abutting ends 18, 19 of the card clothing 12, but it also ensures that those ends are attached securely to the doffer roll 11. The clothing 12 is stretched and tensioned slightly about the periphery of the doffer roll 11 when the clamps or retainers 22, 22' are snapped and secured into place, whereby the clothing 12 tightly hugs the roll 11, and remains firmly in place during use. The tensioning of the clothing 12 on the doffer roll, together with the firm clamping thereof provided by the retainers or clamps 22, 22', ensures that the doffer 10 has a periphery which is completely and uniformly covered by wire.

Thus, the invention further provides a "full width" or "straight wound" doffer, i.e. a doffer whereof the card clothing is not helically wound, but constitutes an integral wire-covered fiber working surface. Accordingly, the entire peripheral surface of the doffer 10 can function as a fiber transfer area.

Preferably, the wire covering of the main cylinder (not shown) of the fiber feeding unit is helically wound, as in past practice. It is preferred to use a helical wound main cylinder in order to properly comb, i.e. draw out and flatten into sheet form, the sliver fibers being fed into the unit by the sliver feed rolls (not shown). This ensures that the fibers are properly transferred to the doffer in the form of a thin film or layer for delivery to the needles of the knitting machine. Thus, in the preferred practice of this invention, a main cylinder having spirally wound card clothing feeds fibers to a doffer having a one piece full width layer of card clothing. Since the doffer rotates faster than the main cylinder, on the order of about a 2:1 ratio, the doffer wires 14 tend to parallelize the fibers being transferred from the main cylinder to the needles, thereby improving the quality of the density and appearance of the pile surface of the fabric being knit.

Although a preferred embodiment of this invention has been shown and described herein for the purpose of illustration, as required by Title 35 U.S.C. 112, it is to be understood that various changes, modifications and alterations may be made thereto without departing from the spirit and utility of this invention, or from the scope thereof as set forth in the claims.

I claim:

1. A doffer for feeding fibers to the needles of a sliver high pile fabric knitting machine, said doffer including a smooth-peripheried doffer roll mounting wire-covered card clothing, characterized by (a) a segment of card clothing enveloping the periphery of the doffer roll and having spaced ends disposed in abutting relation on said roll and (b) fastening means for tightly securing the segment of card clothing to the doffer roll, said fastening means comprising (i) a pair of clamps mounted on the doffer roll, each clamp having a plate disposed on the periphery of the doffer roll, (ii) each clamp having a row of impaling points mounted on the plate and extending transversely relative to the periphery of the doffer roll for engaging one of the two abutting ends of the segment of card clothing, and (iii) clamp securing means affixing each clamp to the doffer roll.

2. The doffer of claim 1, characterized by (a) a slot formed in the periphery of the doffer roll, (b) each said clamp having a stem extending through the slot radially inward relative to the periphery of the doffer roll, and (c) stem connecting means affixing the stem to the periphery of the doffer roll, (d) said stem and stem connecting means constituting the clamp securing means aforesaid.

3. The doffer of claim 1 having clamp securing means characterized by (a) a threaded stem affixed to each clamp and extending radially inward relative to the periphery of the doffer roll, and (b) a nut engaged threadingly on the stem of each clamp to affix the clamp to the doffer roll.

4. The doffer of claim 1, characterized by (a) a transverse groove formed in the periphery of the doffer roll and (b) each clamp of the pair of clamps having its said plate disposed within the transverse groove in the periphery of the doffer roll.

5. The doffer of claim 1, characterized by (a) an arcuate groove formed in the periphery of the doffer roll and having circumferentially spaced edges extending transversely across the doffer roll, (b) each clamp of the pair of clamps having its plate disposed within said groove, (c) each said plate having an inner transverse edge and an outer transverse edge, (d) the outer transverse edge of each plate being contiguous with one of the spaced edges of the groove in the periphery of the doffer roll and the inner transverse edges of the said plates being disposed in opposing relation to each other, and (e) a row of spaced points mounted on each plate adjacent its inner transverse edge for impalement of the segment of card clothing.

6. The doffer of claim 5, characterized in that each row of points impales the segment of card clothing at a location spaced from one of the two abutting ends of said segment, whereby the abutting ends of the card clothing segment are pressed together to provide a tight joint devoid of gaps.

7. The doffer of claim 1, wherein the segment of card clothing is rectangular in shape and has a width substantially equal to the width of the periphery of the doffer roll and a length substantially equal to the circumference of the doffer roll.

8. The doffer of claim 1, characterized by a covering interposed between the periphery of the doffer roll and the card clothing, said covering having a smooth outer surface to facilitate the card clothing being tensioned and stretched slightly when secured to the doffer roll.

9. A wire-covered doffer for feeding fibers to the needles of a sliver high pile fabric knitting machine, said doffer including a smooth-peripheried doffer roll mounting wire-covered card clothing, characterized by (a) a generally rectangular segment of card clothing surrounding the periphery of the doffer roll and having longitudinally spaced edges disposed in contiguous relation transversely on said roll, (b) a pair of circumferentially spaced clamps mounted on the doffer roll for tightly securing the segment of card clothing to the periphery of said roll and (c) a row of spaced points mounted on each clamp for impalement of the segment of card clothing, (d) each said row of spaced points extending transversely relative to the periphery of the doffer roll and (e) each said row of spaced points impaling the segment of card clothing at a location spaced from one of the two contiguous edges of the segment of card clothing, (f) whereby the contiguous edges of the card clothing segment are pressed together to provide a tight joint devoid of gaps and the doffer roll is completely and uniformly covered by wire.

10. The doffer of claim 9, characterized by (a) each clamp of the pair of clamps having a plate disposed on the periphery of the doffer roll, (b) each said plate having an inner transverse edge and an outer transverse edge, said inner transverse edges of said plates being disposed on the periphery in opposing relation to each other, and (c) a row of said spaced points mounted on each plate adjacent its inner transverse edge.

11. The doffer of claim 10, characterized by securing means affixing each clamp to the doffer roll, each said securing means comprising (a) a stem affixed to the clamp plate and extending radially inward relative to the periphery of the doffer roll and (b) stem fastening means engageable with the stem to affix the stem to the periphery of the doffer roll.

12. A doffer for feeding fibers to the needles of a sliver high pile fabric knitting machine, said doffer including a smooth-peripheried doffer roll supporting wire-covered card clothing, characterized by (a) an integral segment of card clothing covering the periphery of the doffer roll and having spaced ends disposed in abutting relation on said roll and (b) fastening means for tightly securing the segment of card clothing to the doffer roll, said fastening means comprising (i) at least two card clothing retainers mounted on the periphery of the doffer roll, (ii) each said retainer having plural impaling points for engaging the card clothing, and (iii) securing means affixing each retainer to the periphery of the doffer roll.

13. The doffer of claim 12, characterized by each retainer having (a) a plate extending transversely over the periphery of the doffer roll and (b) a row of impaling points mounted on the plate and extending generally radially outward relative to the periphery of the doffer roll.

14. The doffer of claim 13, characterized in that the impaling points impale the segment of card clothing at locations proximate to the abutting ends of the segment of card clothing, whereby said abutting ends are pressed together to provide a tight joint.

15. The doffer of claim 12, whereby the integral segment of card clothing has a width substantially equal to the width of the periphery of the doffer roll.

* * * * *